US006279278B1

(12) United States Patent
Morris et al.

(10) Patent No.: US 6,279,278 B1
(45) Date of Patent: Aug. 28, 2001

(54) TOP CAP ARRANGEMENT FOR UPRIGHT WALL PANEL

(75) Inventors: John F. Morris, Nashville; William Thomas Cassidy; T. Lynn Roney, both of Franklin, all of TN (US)

(73) Assignee: Anderson Hickey Company, Nashville, TN (US)

( * ) Notice: Subject to any disclaimer, the term of this patent is extended or adjusted under 35 U.S.C. 154(b) by 0 days.

(21) Appl. No.: 09/654,011

(22) Filed: Sep. 1, 2000

(51) Int. Cl.[7] ..... E04H 1/00

(52) U.S. Cl. ..... 52/239; 52/238.1; 52/241; 52/656.9

(58) Field of Search ..... 52/238.1, 239, 52/241, 656.9

(56) References Cited

U.S. PATENT DOCUMENTS

| | | | |
|---|---|---|---|
| 4,269,005 | | 5/1981 | Timmons . |
| 4,361,994 | * | 12/1982 | Carver ..... 52/238.1 |
| 4,891,922 | | 1/1990 | Hozer et al. . |
| 5,070,666 | | 12/1991 | Looman . |
| 5,274,975 | * | 1/1994 | Haag ..... 52/300 |
| 5,347,778 | | 9/1994 | Bray . |
| 5,839,240 | | 11/1998 | Elsholz et al. . |

OTHER PUBLICATIONS

Anderson Hickey Co., drawings of end plug (part No. E100–0401)(Oct. 5, 1998) and FSI top panel cap (part No. E100–1201 thru 1206)(Sep. 28, 1998) provided in the IDS.*

Drawing Sheets A–E, "ah"; illustrating Assignee's prior art top cap arrangement.

* cited by examiner

*Primary Examiner*—Carl D. Friedman
*Assistant Examiner*—Bennett Porterie
(74) *Attorney, Agent, or Firm*—Flynn, Thiel, Boutell & Tanis, P.C.

(57) ABSTRACT

A top cap arrangement for an interior space-dividing wall panel arrangement which mounts on and projects upwardly from a floor for dividing a floor area into a plurality of smaller working areas. The panel arrangement is defined by a plurality of individual panel members which are less than ceiling height, and have an interior frame construction which includes an elongate top frame element which extends along and defines the upper surface of the panel member. A top cap member mounts on and extends horizontally along the top frame element, and is constructed of a material which permits at least limited transverse flexibility. The top cap member has a channel-like configuration which includes outer side flanges which slidably overlap and embrace exterior sides of the panel member to permit at least limited vertical positional adjustability of the top cap member relative to the panel member. A corner cap member for creating a continuous top cap arrangement when the panels are arranged to define a two-panel right-angle corner is also provided.

18 Claims, 12 Drawing Sheets

TOP CAP ARRANGEMENT FOR UPRIGHT WALL PANEL

FIELD OF THE INVENTION

This invention relates to an improved top cap arrangement for use on an interior space dividing wall panel system.

BACKGROUND OF THE INVENTION

Commercial businesses and specifically office environments frequently utilize portable space-dividing panel or wall systems for dividing large open areas into small work spaces. The wall system typically is formed by a plurality of individual upright wall panels which are appropriately joined together either directly or through intermediate connecting structures, such as upright support posts or the like, and the wall panels are appropriately arranged into desired geometrical configurations to define work spaces for individual occupants. The individual panels conventionally join in aligned relationship, and also traditionally connect at corners which define either a two-panel connection creating a right angle corner, or a three-panel connection which has a generally T-shaped configuration so as to define a corner between two adjacent work spaces. The individual panel typically includes horizontally elongated top and bottom frame elements or rails which rigidly join at opposite ends to vertically-extending edge or end frame elements. The edge frame element in turn frequently detachably mounts thereon a vertically elongate edge rail which defines the finished edge of the panel member, and which also cooperates with an opposed edge rail of an adjacent panel to permit interconnection therewith through an appropriate connecting structure such as a spline, support post or the like. The individual wall panels themselves are also provided with a top cap structure which mounts on and extends horizontally therealong to provide a finished and closed appearance to the wall panel. This top cap structure generally extends along the horizontal length of the upper edge of the individual panel member, and in addition also typically includes separate top cap covers or elements which are disposed to fill the corner space defined when a two-panel or three-panel right-angle corner is formed. The known top cap arrangements, however, have long presented problems with respect to such wall systems, particularly with respect to proper fit, assembly and aesthetics.

In one type of conventional top cap arrangement, a horizontally elongate top cap of generally rigid construction, typically metal construction, is secured to and extends along the upper edge of the wall panel so that it extends along not only the upper frame but also overlaps the upper ends of the separate edge rails. In the case of a two-way or three-way corner, then a separate corner cap member is provided, and is generally supported on some type of separate posts or support structure which is utilized to define or enclose the corner space. These rigid top caps, however, are typically somewhat difficult to assemble on the panel, and in addition do not readily accommodate dimensional irregularities in the panel, such as due to manufacturing tolerances, and thus can result in an unsightly or aesthetically undesirable appearance.

In an effort to avoid the difficulties associated with rigid top caps and to provide for a more economical construction, known top cap arrangements have also adopted the use of top cap members formed of plastic materials. In one known arrangement as developed and marketed by the Assignee hereof, a horizontally elongate top cap member extruded from plastic and hence having at least limited flexibility was provided for mounting on the wall panel, with this top cap member having a length which generally corresponds solely to the length of the top rail so as to hence not overlap the vertical edge rail. A separate small end cap member, also of plastic, was then mounted on the upper end of the edge rail for alignment with the end of the top cap member, and was provided with a flange which projected into the adjacent end of the top cap member to assist in providing structural continuity therebetween. In addition a separate plastic top corner cap member was provided for disposition at a two-way or three-way corner, and this top corner cap member included sidewardly projecting T-flanges for engagement on the upper ends of the edge rail of adjacent panels. In this known top cap arrangement, however, it was noted that dimensional variations in the panel structure due primarily to manufacturing tolerances again presented difficulties which interfered with proper seating of the top cap arrangement, specifically the top cap member and the end cap member, and which resulted in an unsightly appearance. For example, due to manufacturing tolerance associated with the various elements of the panel construction and the assembly thereof, it has been noted that the upper edge of the edge rail relative to the elevation defined by the upper surface of the top frame rail may vary by as much as about plus or minus 0.100 inch. Thus, when the edge rail is significantly higher than the top rail, the cooperation between the end cap member and the elongated center top cap member can prevent the top cap member from properly seating on the top rail and in addition can cause undesired and unsightly distortion of the flexible top cap member. Conversely, when the upper edge of the top edge rail is significantly below the elevation of the top of the edge rail, then the end cap member due to its cooperative engagement with the top cap member is unable to properly seat downwardly on the upper end of the edge rail, and again an unsightly gap is created. Further, the corner cap members are also unable to maintain a proper positional and structural relationship with the adjacent panels and hence further contribute to an undesirable appearance.

Accordingly, it is an object of this invention to provide an improved top cap arrangement for an interior space-dividing wall panel arrangement, which top cap arrangement improves upon and in fact overcomes many disadvantages associated with prior top cap arrangements.

More specifically, this invention relates to an improved top cap arrangement for an interior space-dividing wall panel arrangement which mounts on and projects upwardly from a floor for dividing a floor area into a plurality of smaller working areas. The panel arrangement is defined by a plurality of individual panel members which can be horizontally serially adjoined in aligned relation, and which can also be connected in right angle relationship to define a two-panel or a three-panel corner. The individual panel members are less than ceiling height, and have an interior frame construction which includes a horizontally elongate top frame element which extends along and defines the upper surface of the panel member on which the top cap arrangement mounts. The panel member also includes separate edge rails which extend vertically along opposite ends of the panel member and which have upper surfaces which terminate substantially flush with and which overlap the ends of the top rail member so that the edge rails and top frame member have substantially flush upper surfaces except for manufacturing tolerances. In the top cap arrangement of this invention, there is provided a top cap member which mounts on and extends horizontally along the top frame element, with the length of the top cap member being slightly less than the length of the upper edge. This top cap member is preferably molded of plastic material so as to have at least limited transverse flexibility, and has a channel-like configuration which includes outer side flanges which slidably overlap and embrace exterior sides of the panel member to permit at least limited vertical positional adjustability of the top cap member relative to the panel member. In addition, a small end cap member, also preferably of plastic, mounts on the upper end of the edge rail and includes flanges which snugly telescope into the adjacent end of the top cap member to create a secure structural cooperation therebetween so as to provide for a substantially continuous and aligned connection of the top cap member and end cap member. The end cap member also has a peripheral vertical wall or edge flange which overlaps the exterior surface of the edge rail at the upper end thereof to permit at least limited vertical positional adjustability of the end cap member relative to the edge rail. The mounting of the top cap member and end cap member on the respective top frame element and edge rail, and the cooperative connection between the end and top cap members, thus ensures a proper aligned relationship therebetween irrespective of manufacturing tolerances of the panel member and also ensures that these cap members remain properly engaged with the panel member and appropriately accommodate manufacturing tolerances so as to prevent creation of unsightly gaps or the like between the top cap arrangement and the panel member.

The top cap arrangement of the invention also includes an improved corner cap member for creating a continuous top cap arrangement when the panels are arranged to define a two-panel right-angle corner. In this arrangement, the two panels defining a right-angle corner are not provided with end cap members at the corner, and in place thereof a corner cap member is provided. The latter has a horizontally enlarged configuration so as to effectively occupy the upper extremity of the corner, and includes cantilevered extensions associated with two adjacent sides of the corner cap member for cooperating with the two adjacent panels. Each of the cantilevered extensions includes an inner part which effectively overlies the upper end of the edge rail so as to occupy the region normally occupied by the end cap member, and this inner edge part in turn has a flange cantilevered therefrom for telescopic projection into the adjacent end of the top cap member to thereby define a snug structural connection therewith which provides structural support for the corner cap member and provides for structural and substantially visual continuity of the top cap arrangement. A similar corner cap member is provided for creating a three-panel corner connection except that this three-way corner member has cantilevered flange structures associated with opposite sides thereof so as to cooperate with the opposed aligned panels defining the three-panel corner arrangement.

Other objects and purposes of the invention, as well as operational and structural advantages associated with the top cap arrangement, will be apparent upon reading the following specification and inspecting the accompanying drawings.

Figure 1:
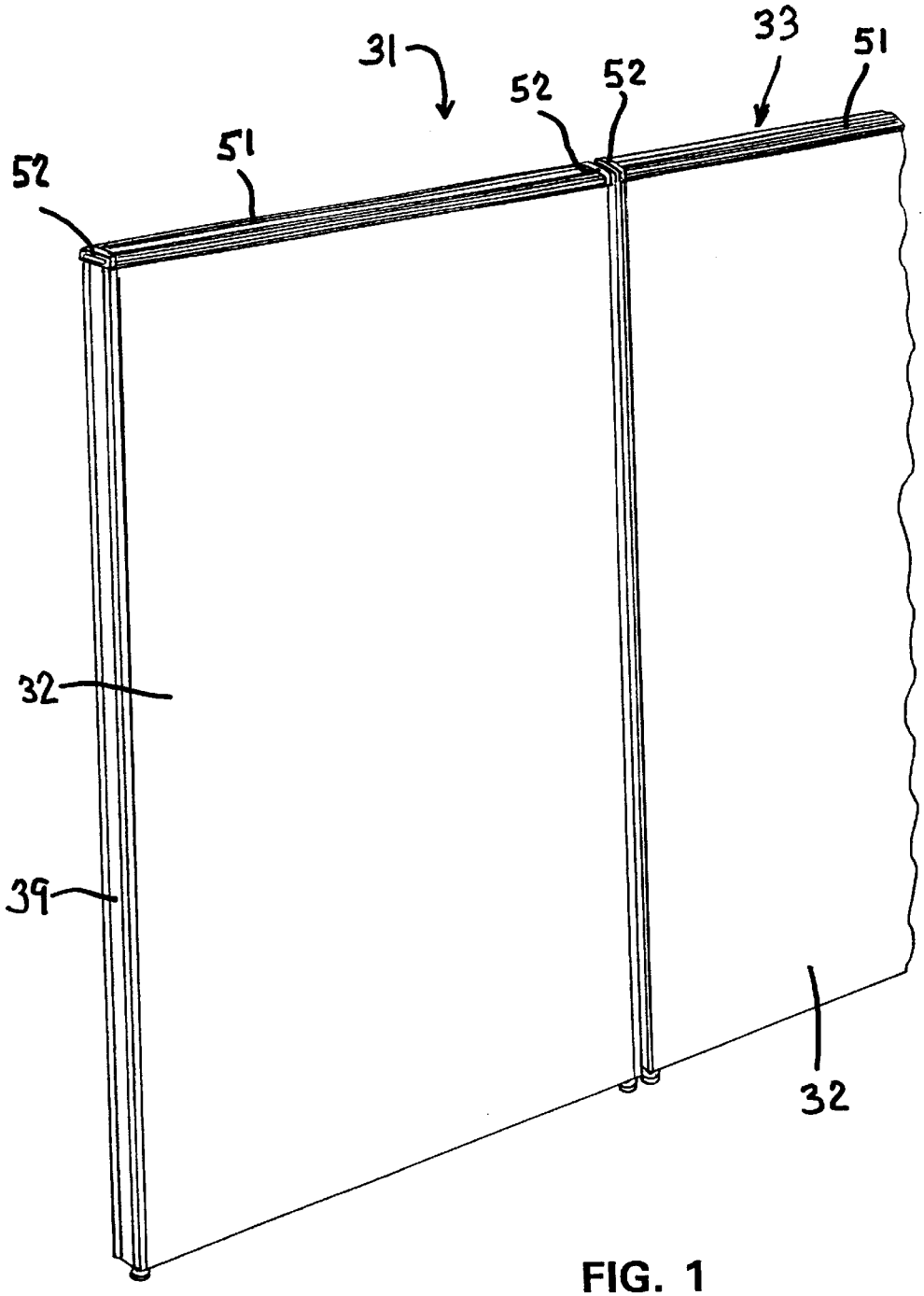
FIG. 1 is a fragmentary perspective view illustrating two panel members serially connected together and mounting thereon the improved top cap arrangement of the present invention.
Figure 2:
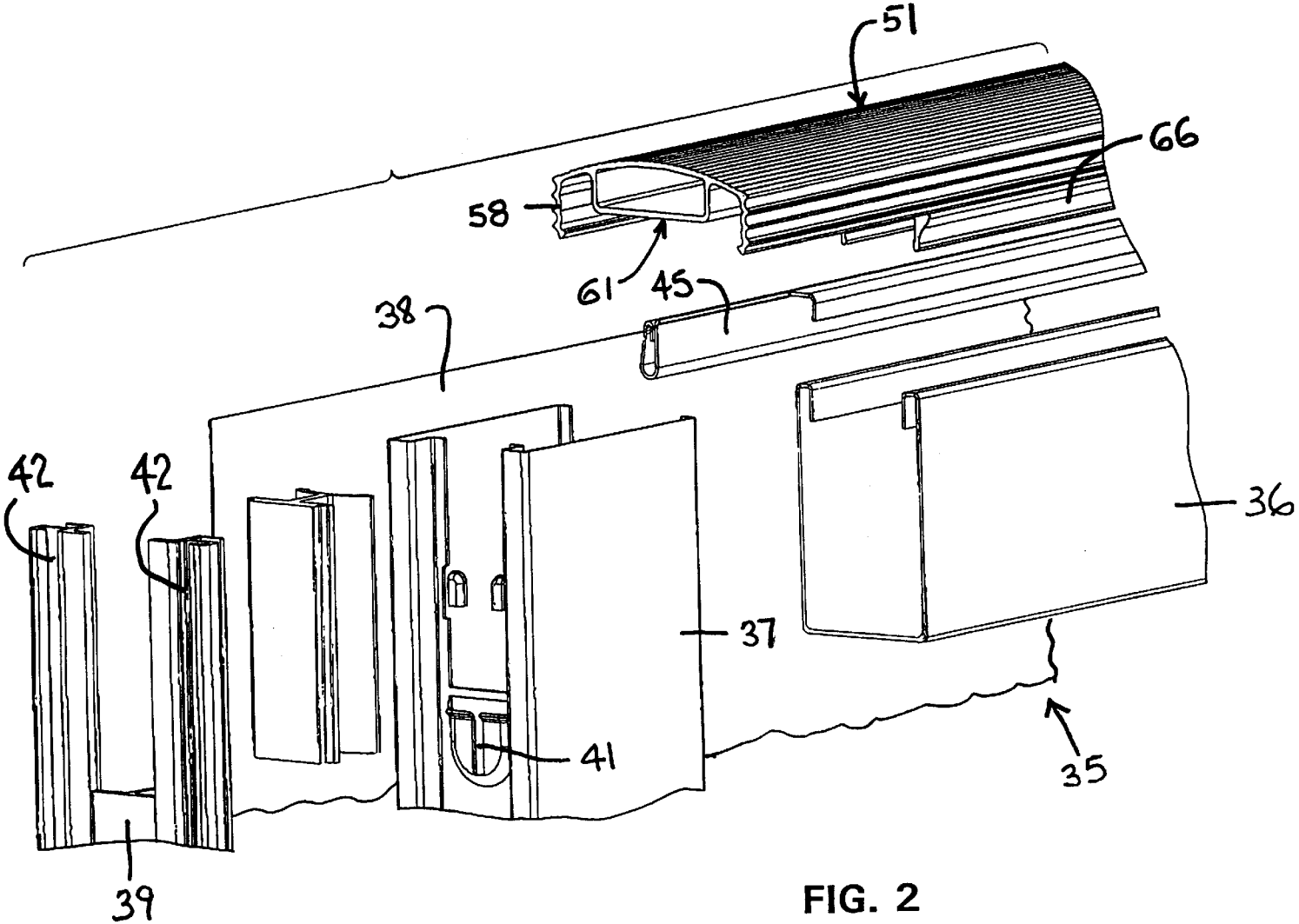
FIG. 2 is a fragmentary exploded view which illustrates an upper corner of a panel member and its cooperation with the top cap member.
Figure 3:
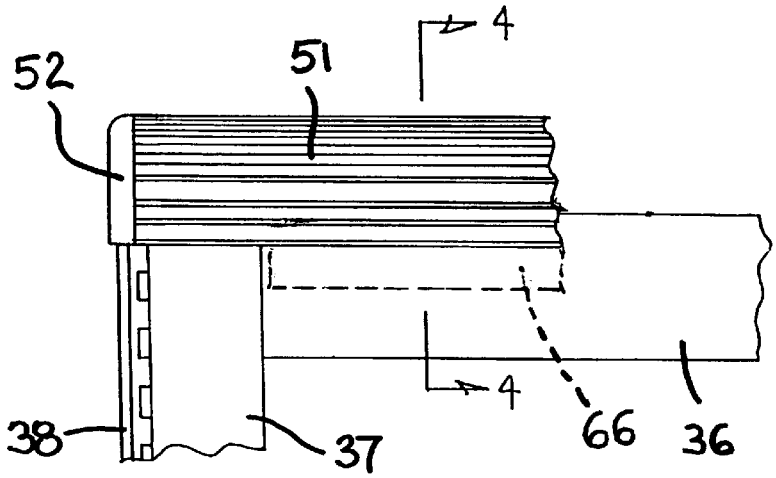
FIG. 3 is a fragmentary side elevational view of an upper corner of a panel member with the top cap and end cap members mounted thereon, but with the side layers of the panel member removed so as to illustrate the frame construction.

Certain terminology will be used in the following description for convenience in reference only, and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the panel member or designated parts associated therewith. Said terminology will include the words specifically mentioned, derivatives thereof, and words of similar import.

DETAILED DESCRIPTION

Referring to the drawings and specifically FIGS. 1–4, there is illustrated part of an interior upright space-dividing wall system 31 of the type used for dividing interior open spaces into smaller workspaces. The wall system 31 of FIG. 1 illustrates a pair of upright wall panels 32 which are serially connected in generally aligned relationship. A top cap arrangement 33 is associated with the wall panel system, specifically the upper edges of the individual panel members, so as to effect closure of the wall panels and define an aesthetically pleasing appearance.

The individual panel member 32 includes an interior frame 35 which typically includes a rigid ring-like rectangular frame construction defined by generally horizontally extending and substantially parallel top and bottom frame members, only the top frame member 36 being illustrated in the drawings, with a similar channel or rail (not shown) defining the lower frame member and extending horizontally along the lower edge of the panel member. The top and bottom frame members are in turn joined at opposite ends to vertically extending side or end frame members 37 which cooperate to define a generally rectangular center opening in which a sheet of paper honeycomb construction is typically positioned. The panel frame additionally includes thin sheet-like side skins 38, such as thin metal plates, which overlie both sides of the rectangular frame and are fixed thereto so as to effectively enclose the paper honeycomb layer therebetween, only one such side skin 38 being illustrated in FIG. 2. Opposite ends of the frame also mount thereon vertically elongate edge rails 39 which define the finished vertical end edges of the panel member. The edge rails 39 typically are removably attached to the respective side frame member 37 in any conventional manner, which typically involves two or more hooks which project from the inner surface of the edge rail 39 and engage within appropriate slots 41 provided on the side frame member 37. The edge rail 39, in the illustrated embodiment, has a pair of slots 42 extending vertically thereof for mounting one end of a conventional vertically-elongate hinge member, commonly referred to as a living hinge strip, for hingedly connecting the edge rails of two adjacent panel members together. This construction is conventional and well known.

Figure 4:
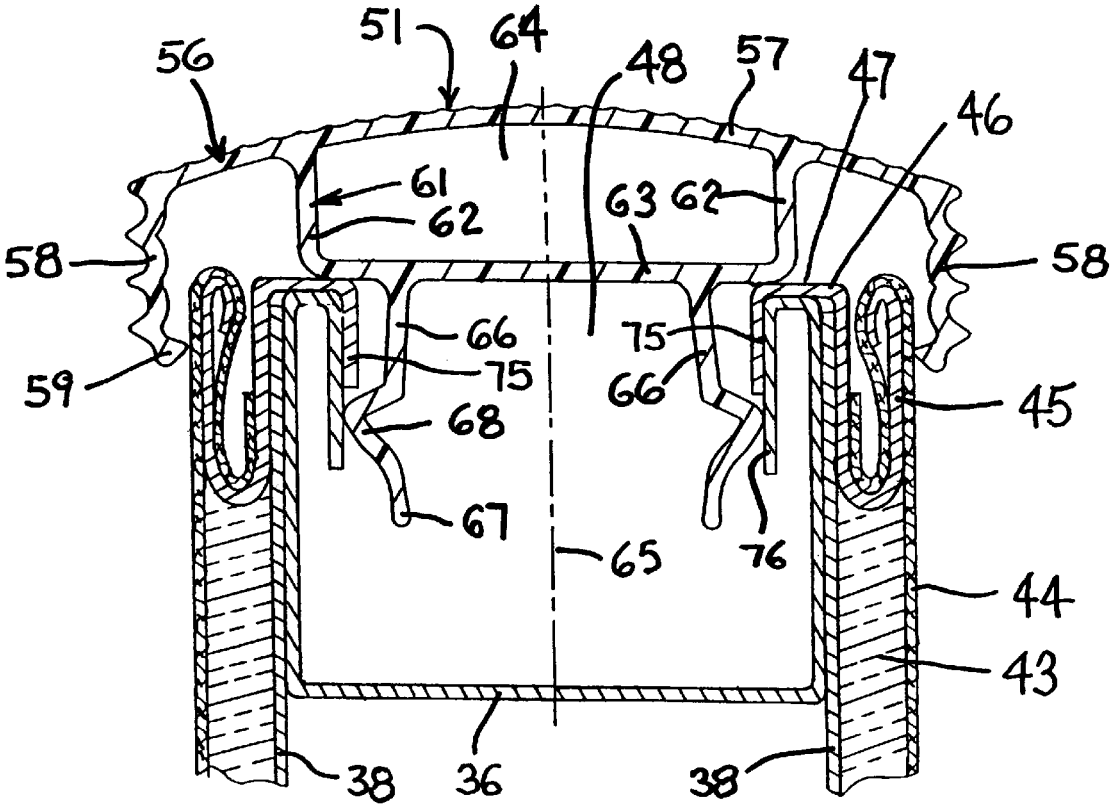
FIG. 4 is an enlarged fragmentary sectional view illustrating the top of a panel member having a top cap mounted thereon, such being taken generally along line 4—4 in FIG. 3.
Figure 5:
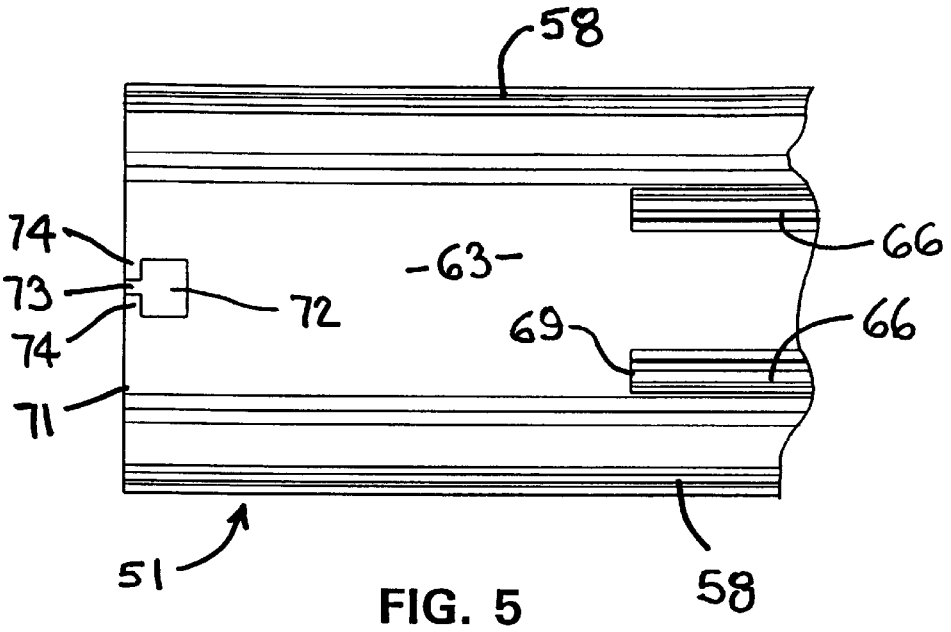
FIG. 5 is a bottom view illustrating a portion of the top cap member adjacent one end thereof.
Figure 6:
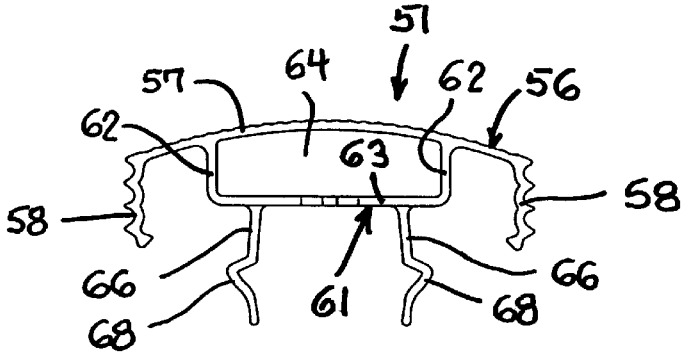
FIG. 6 is an end elevational view of the top cap member.
Figure 7:
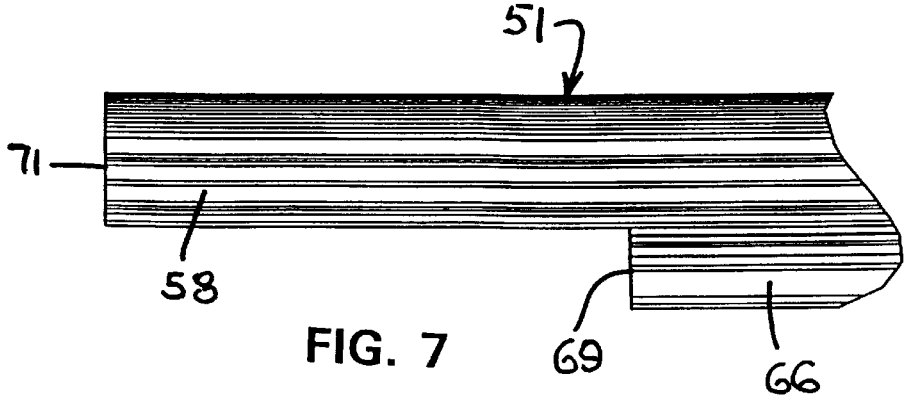
FIG. 7 is a side elevational view of the portion of the top cap member illustrated by FIG. 5.
Figure 8:
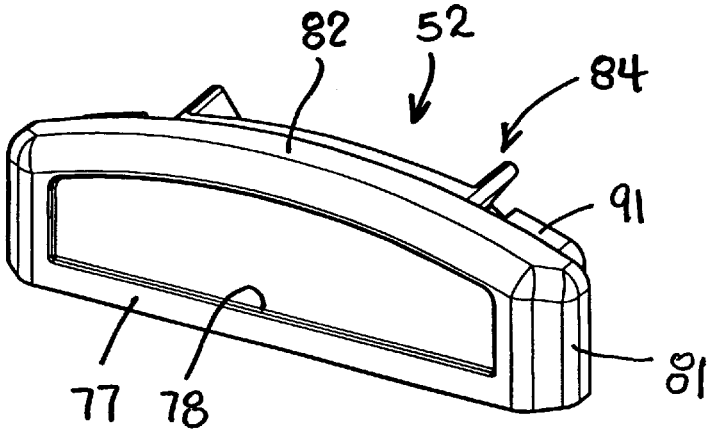
FIG. 8 is a perspective view which illustrates the outer side of the end cap member.

The panel member also typically, and in the illustrated embodiment, includes flexible sound-absorbing layers 43 disposed in external overlapping relationship to the side skins 38, such layers typically being of fiberglass. This layer 43 in turn typically has an outer layer of flexible fabric 44 disposed thereover so as to define the exposed exterior side surface of the panel member. The edge portions of the side fabric 44 are normally retained within suitable elongate retainer strips 45 which mount in a conventional manner on the top, bottom and side frame members so as to permit securement of the fabric while maintaining it in a taut and generally stretched condition over the underlying fiberglass layer. The retainer strip 45 associated with the top frame member 36, as illustrated in FIG. 4, has a top wall 46 which overlies the upper edge of the top frame rail 36 and which in turn defines thereon an upper surface 47 which effectively defines the top surface of the panel member frame.

The top frame member 36 is, in the illustrated embodiment, preferably of an upwardly-opening channel-shaped cross section so as to define therein an elongate channel 48 which is open along the top thereof and hence is accessible through an open mouth as defined between the upper edges of the side legs of the top frame member, which upper edges have the retainer strips 45 mounted thereon.

The open channel defined by the top frame member 36, and the vertical open channel defined by the side frame rails 37, and the continuous communication between the channels of the top and side frame rails where they intersect at the panel corners, permits cables (power and/or telecommunication) to be positioned therein so as to enable such cables to extend longitudinally along the wall system or vertically thereof for utilization and connection thereto. The edge rails 39 adjacent the upper ends thereof also have vertically elongate slots opening therethrough, closable by means of a removable blocker, to facilitate feeding of cables between the top frame rails of adjacent panels.

The overall construction of the wall panel system 31 and specifically the panel members 32, as briefly summarized above, is conventional. Further detailed description thereof is believed unnecessary. It will also be appreciated that numerous other conventional variations can be incorporated into the construction of the wall panel member or wall system if desired.

Figure 15:
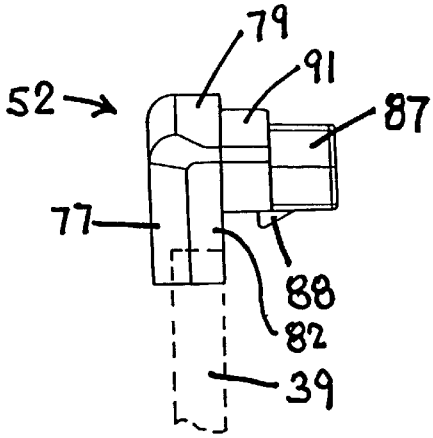
FIG. 15 is a side elevational view of the end cap member.
Figure 22:
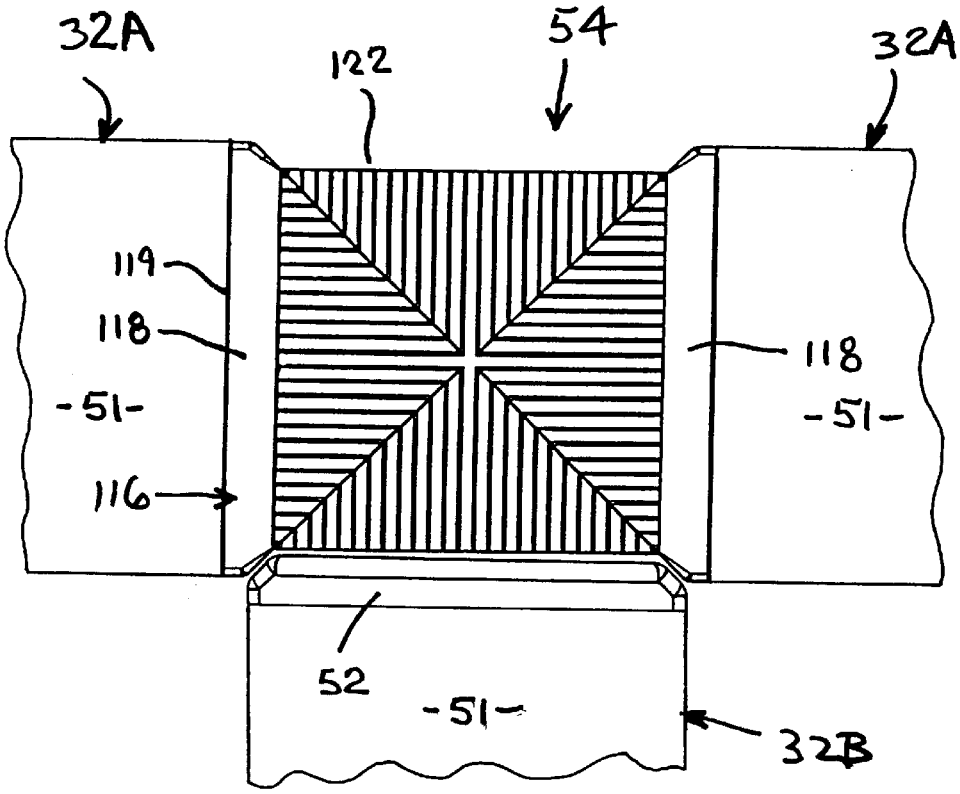
FIG. 22 is a diagrammatic top view which illustrates three panels disposed in a T-shaped corner configuration with a straight two-panel connector cap joined between the aligned panels and cooperating with the end cap mounted on the transversely-projecting third panel.
Figure 23:
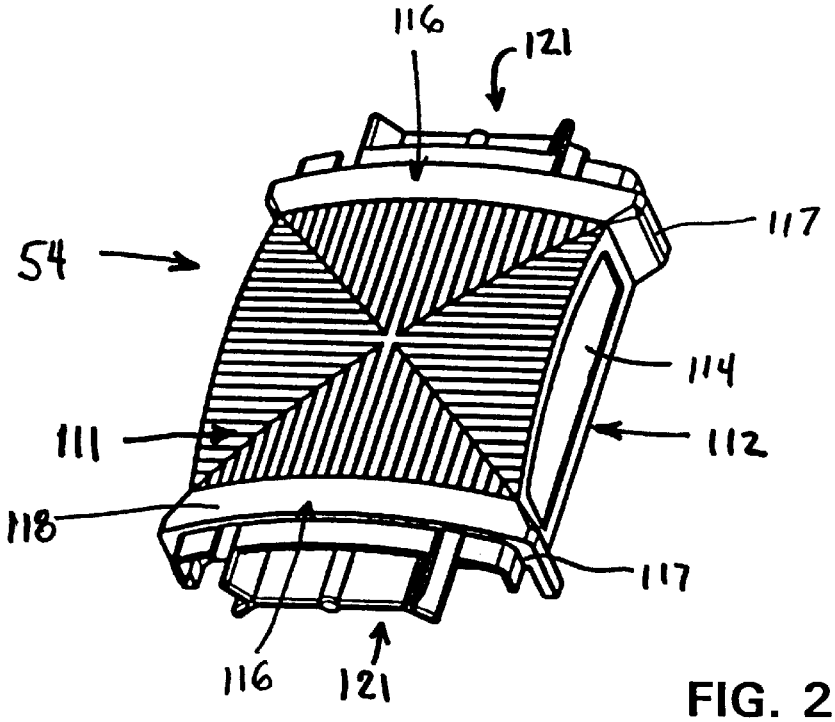
FIG. 23 is a top perspective view of the in-line two-panel connector cap of FIG. 22.

The top cap arrangement 33 of the present invention includes a top cap member 51 which is longitudinally elongated so as to sit on and extend along the top of the individual panel member throughout substantially the entire length thereof, with opposite ends of the top cap member 51 being closed by separate end cap members 52 which effectively define the upper corners of the panel member. In situations where two panel members are joined to define a right-angle corner, then at such corner the end cap members 52 are not utilized, and in their stead a two-way corner cap 53 (FIG. 15) is provided and structurally connects the adjacent ends of the two top cap members 51 as provided on the respective panel members. In a situation where at least three panels are disposed to define a generally T-shaped corner, then the aligned panels are not provided with end cap members 52, but instead the top cap members of the aligned panels are joined by a straight in-line corner cap member 54 (FIG. 22). The construction of the cap members 51, 52, 53 and 54 will now be described in greater detail.

Considering first the top cap member 51, and referring to FIGS. 2–7, this member 51 is an elongated one-piece member having a length which substantially equals but is just somewhat shorter than the overall horizontal length of the respective panel member on which it mounts. The top cap member 51 is defined by a downwardly-opening main channel part 56 which extends throughout the length of the top cap member and includes a top wall 57 which at opposite edges is integrally joined to side flanges 58 which are cantilevered downwardly in generally parallel relationship. The side flanges 58 adjacent the lower free ends thereof are provided with ribs 59 which extend longitudinally along the length of the side flanges and which project inwardly to create a gripping engagement with the exterior side surfaces of the panel member. The transverse or sideward spacing between the side flanges 58 preferably slightly exceeds or approximately equals the thickness of the finished panel member so that the upper edge of the panel member can hence telescope upwardly between the side flanges 58, with the ribs 59 associated with the lower edges of the flanges 58 effectively creating a snug engagement with the exterior side surfaces of the panel member to assist in holding the top cap member positionally on the panel member, as illustrated in FIG. 4.

To improve the aesthetics of the top cap member 51, the top wall 57 preferably has, in transverse cross-section, a convex rounded or arcuate profile, and the outer or exposed surfaces of the side legs 51 are provided with a series of ribs and grooves extending longitudinally thereof.

Top cap member 51 also includes an upwardly oriented inner channel part 61 which, like the outer main channel 56, extends throughout the entire length of the top cap member. The inner channel part 61 includes generally parallel side walls 62 which are joined to and project downwardly from the underside of the top wall 57, which side walls 62 at their lower ends are integrally joined by a generally horizontal bottom wall 63. The side walls 62, bottom wall 63, and center portion of the top wall 57 thus cooperate to define a substantially closed tubular profile which defines therein a tunnel-like opening 64 which opens outwardly through opposite ends of the top cap member 51.

The channel parts 56 and 61 are positioned centrally or symmetrically relative to a central vertical plane 65 which extends longitudinally of the top cap member, which plane 65 also defines the central vertical plane of the respective panel member.

Top cap member 51 also has a pair of cantilevered resilient retaining flanges 66 disposed symmetrically on opposite sides of the center plane 65 and extending downwardly from the bottom wall 63. The flanges 66 function like cantilevered springs in that they project downwardly so as to terminate at free ends 67, and intermediate the vertical extent thereof the flanges 66 are provided with camlike projections 68 which project outwardly with a generally V-like configuration, and extend longitudinally throughout the length of the respective flange.

In the illustrated and preferred embodiment, the flanges 66 extend lengthwise throughout a majority of the length of the cap member 51 except that the flanges 66 terminate at longitudinal ends 69 which are spaced inwardly a small distance from the respective free ends 71 of the top cap member. The inward spacing of longitudinal end 69 from adjacent free end 71 is selected so that the flanges 66 terminate at or short of the vertical frame rails 37 (FIG. 2) so as to permit open communication between the interiors of the horizontal and vertical frame rails 36 and 37 to permit free passage of power or telecommunication cables therebetween.

The sideward spacing between the flanges 66 is selected so that these flanges can be readily moved downwardly into the upwardly opening channel 48 of the top rail 36, substantially as illustrated in FIG. 4. During initial downward insertion of the flanges 66 into this channel, the projections 68 on the flanges 66 initially engage the inner flanges 75 on the fabric retainer strips so that the flanges 66 are resiliently deflected inwardly until such time as the projections 68 pass downwardly over the flanges 75, whereupon the projections 68 resiliently snap outwardly into engagement with the inner flanges 76 of the top rail 36. The projections 68 are thus releasably engaged below the lower ends of the flanges 75 as illustrated in FIG. 4.

The top cap member 51, adjacent each free end 71 thereof, also has an opening or hole 72 (FIG. 5) which is formed through the bottom wall 63. This hole is disposed generally on the center plane 65 and is spaced inwardly a small distance from the free end 71. The hole 72 communicates with the free end 71 by means of a small slit 73 extending therebetween, which slit 73 causes cantilevered resiliently deflectable flange portions 74 to be defined on opposite sides thereof. The hole 72 is provided so as to effect engagement with the end cap member 52, as explained below.

The top cap member 51 is preferably constructed as an integral, monolithic, one-piece member, preferably of a plastics material. The cap member 51 in the illustrated embodiment is preferably formed as an elongate extrusion, such as from PVC. This thus permits the cap member to have limited flexibility so as to more readily adapt to the dimensional irregularities of the panel member. At the same time, however, the channel parts 56 and 61 and the tubular section defined thereby, provide the top cap member with desired stiffness.

As illustrated in FIG. 4, the bottom wall 63 of the tubular section 61 projects outwardly beyond the junction with the retaining flanges 66 so that the lower surface of the bottom wall 63, in the region spaced outwardly from the retaining flanges 66, is disposed for abutting or seating contact with the upper surface 47 of the panel member frame when the cap member 51 is assembled thereon.

Considering now the end cap member.52, and referring specifically FIGS. 8–15, the end cap member is a one-piece member which includes an upright end wall 77 which, on the outer side thereof, has in the illustrated embodiment a depressed center region 78 which is provided for aesthetic purposes and for accommodating therein a brand logo if desired. The end wall 77 is fixedly, here integrally, joined around the side and upper edges thereof to a U-shaped rim 79 which projects transversely (i.e. horizontally) from the upright end wall 77. The rim 79 includes edge rim walls 81 which extend vertically along opposite sides of the end wall 77 and which, at upper ends, join through rounded corners to a top edge rim wall 82 which extends along and projects inwardly from the upper edge of the end wall 77. The edge and top rim walls 81 and 82 are cantilevered inwardly from the end wall 77 and terminate at a free edge or shoulder 83 which is spaced a small distance inwardly from the inner surface of end wall 77. The rim wall 79 has a size and configuration which generally correspond to the size and configuration of the outer channel part 56 of top cap member 51 so that the shoulder 83 of the end cap 52 will abut against the free end of the main channel part 56 whereby the rim wall 79 of the end cap member thus appears as an extension of the outer surface of the top cap member.

Figure 13:
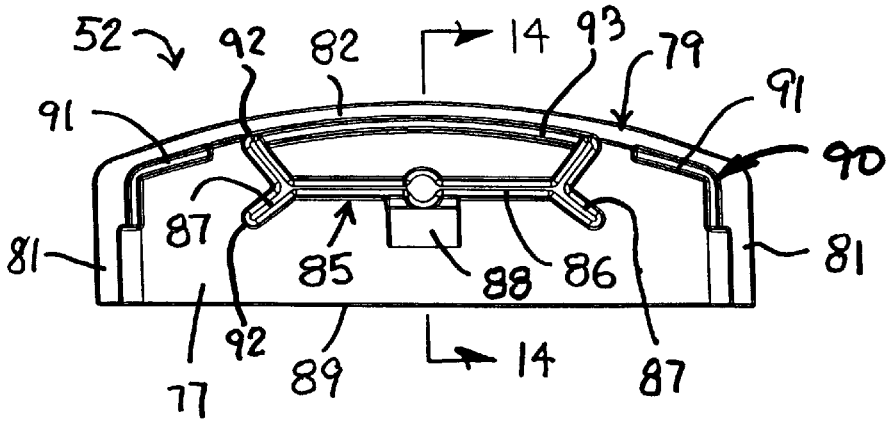
FIG. 13 is an inner end elevational view of the top cap member.

To enable the end cap member 51 to secure to and seat in aligned relationship to the end of the top cap member 51, the end cap member 52 has a first projection structure 85 which projects transversely, here perpendicularly, inwardly from the end wall 77 so as to be insertable into the tunnel-like opening 64 defined by the tubular section 61 of the top cap member 51. The first projection structure 85 includes a center support wall 86 which is cantilevered horizontally outwardly from the end wall 77, with this support wall 86 extending generally horizontally across the center portion of the end wall as illustrated by FIG. 13. The support wall 86, adjacent the opposite edges thereof, is integrally joined to generally L or V-shaped edge members 87 which have legs which angle upwardly and downwardly relative to the center wall 86. Each edge wall member 87, at the free ends of the legs thereof, defines a vertically spaced pair of edge runners or contact areas 92 which are adapted to snugly but slidably engage the inner surface of the tubular section 61 when the end cap member is engaged with the top cap member.

Figure 12:
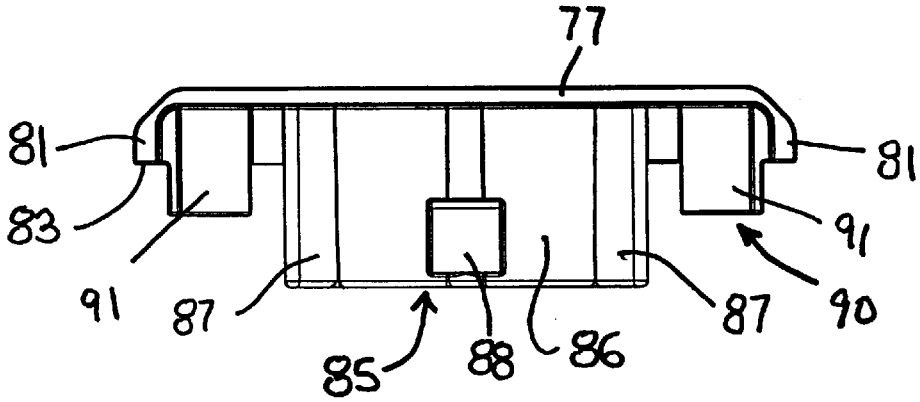
FIG. 12 is a bottom view of the top cap member.

As illustrated by FIGS. 12 and 13, the projection structure 85 is disposed just below the top rim wall 82 and is spaced upwardly from the lower free edge 89 of the end wall 77. The projection structure 85 also projects outwardly from the end wall 77 by a distance which substantially extends beyond the free edge or shoulder 83 defined by the rim wall 79.

Figure 14A:
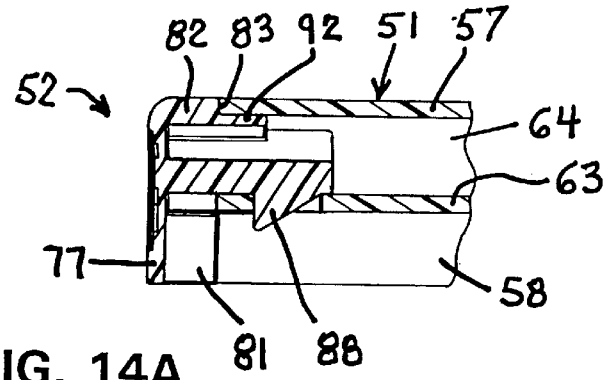
FIG. 14A illustrates, in central cross-section, the end cap member engaged with the adjacent end of the top cap member.
Figure 14:
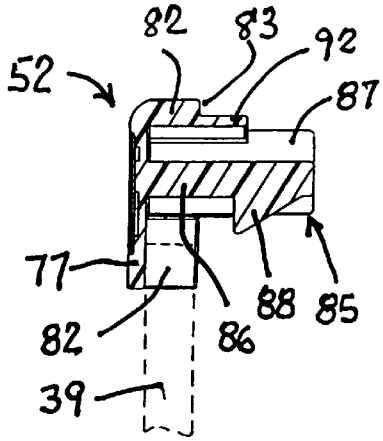
FIG. 14 is a central cross-sectional view of the end cap member taken generally along line 14—14 in FIG. 13.

The first projection structure 85 also mounts thereon a wedge-shaped catch 88 which projects downwardly from the center support wall 86 generally along the central vertical plane, and in the vicinity of the outer free end thereof. This catch 88 has the bottom surface defined with a wedge-like surface which slopes downwardly and terminates in a transverse shoulder as the bottom surface projects toward the end wall 77 as illustrated in FIG. 14.

The first projection structure 85 also has a top flange 93 which extends between the upper contact edges 92 and has an arcuate configuration similar to the top rim wall 82. This top flange 93 is of lesser dimension so that it is hence stepped inwardly and thus defines the free edge or shoulder 83 where it joins to the top edge rim 82. Top flange 93 projects outwardly over only a portion of the distance through which the projection structure 85 extends.

Figure 10:
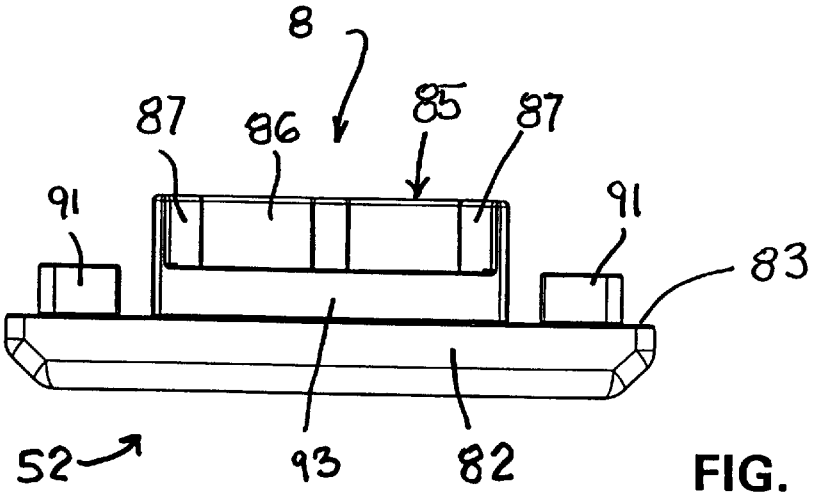
FIG. 10 is a top view of the end cap member.
Figure 11:
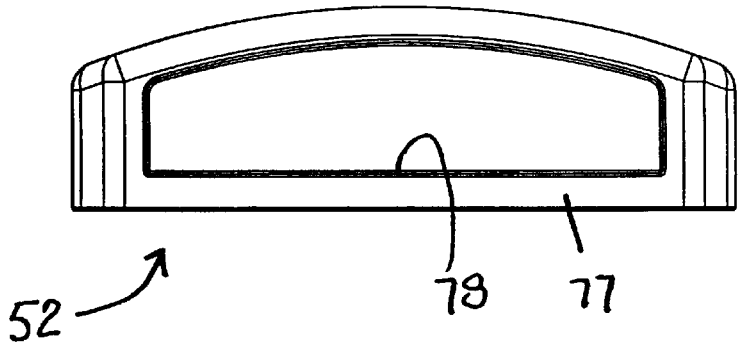
FIG. 11 is an outer end elevational view of the top cap member.

End cap member 52 also has a second projection structure 90 which projects transversely, here perpendicularly, in an inner direction away from the end wall 77. The second projection structure 90, in the illustrated embodiment, includes two projections 91 which are mirror images of one another and disposed uniformly on opposite sides of the center vertical plane of the end member. Each projection 91 is disposed generally at the rounded outer corner of the rim wall and comprises a generally L-shaped cross-sectional member which is effectively joined to the corner of the rim wall and which projects inwardly in generally perpendicular relationship from the end wall 77. The outer surface of this L-shaped projection 91 is spaced inwardly from the outer surface of the adjacent rim wall so as to define the edge or shoulder 83 at the intersection therebetween. The projections 91, like the top flange 93, are disposed so that the cooperating configuration thereof permits them to effectively slidably but snugly engage the inner wall defined by the main channel part 56 adjacent the upper corners thereof. The projections 91, while they project inwardly beyond the free edge 87 of the rim wall, nevertheless terminate at a free end which is spaced significantly short of the free end of the first projection structure 85. The projections 91, however, when viewed from above as shown in FIG. 10, are positioned in outwardly spaced relationship from but on opposite sides of the first projection structure 85.

Figure 9:
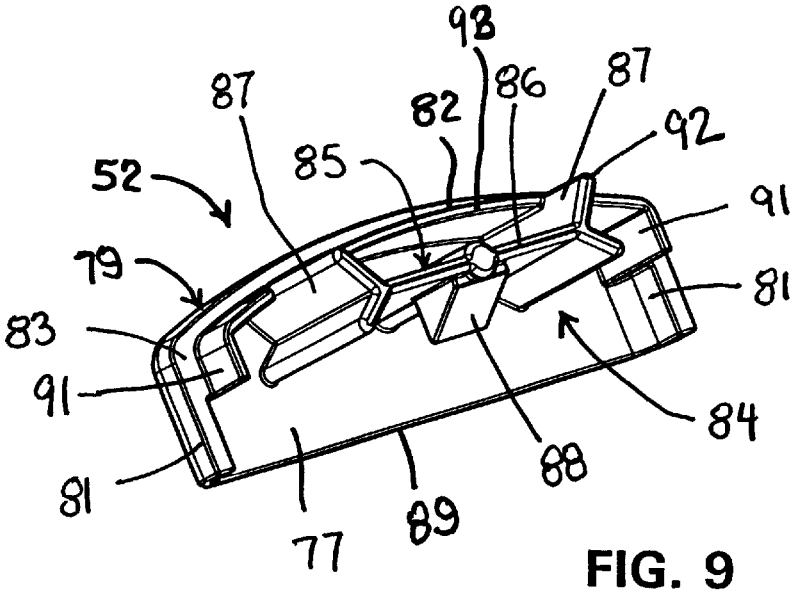
FIG. 9 is a perspective view which illustrates the inner side of the end cap member.

As indicated above, the overall size and configuration of the end cap member 52, when viewed in a vertical plane perpendicular to the central plane 65, generally corresponds to the size and configuration of the top cap member 51 when viewed in transverse cross-section. Further, since the projection structures 85 and 91 are both disposed in their entirety a substantial distance upwardly from the lower edge 89 as illustrated in FIGS. 9 and 13, there is thus defined a pocket or region which is disposed below the projection structure 85 and which is bounded on its outer boundary by the end wall 77, and on the sides by the edge rim walls 81. This open region in the lower interior of the end cap member 52 thus accommodates therein the upper corner of the panel member and specifically the upper end of the vertical edge rail 39, as diagrammatically indicated by dotted lines in FIGS. 14 and 15.

To secure the end cap member 52 to an end of the top cap member 51, the end cap member 52 is disposed in aligned relationship with one end of the top cap member, and the free end of the projection structure 85 is aligned with and then slidably inserted into the tunnel-like opening 64 of the tubular section 61. During this slidable insertion, the longitudinally extending edges or runners 92 are positionally arranged so that they substantially slidably engage the inner wall of the tubular section. During the insertion of the first projection structure 85, the wedge-like catch 88 engages the free end 71 of the bottom wall 63 and causes the flanged regions 74 of the bottom wall to resiliently deflect downwardly until the catch 88 aligns with the opening 72, at which time the split wall portions 74 resiliently snap upwardly behind the rear surface of the catch to thereby fixedly join the end cap member 52 to the top cap member 51.

In addition, after initial insertion of the first projection member 85 into the tubular section 61, the second projections 92 are thereafter slidably inserted into the main channel 56 substantially at the outer corners thereof so as to provide support for the main channel part. The. slidable insertion of the end cap member 52 into the top cap member 51 continues until the shoulder or free edge 83 of the end rim 79 effectively abuts the free end 71 of the top cap member, substantially as illustrated in FIG. 14A. When connected together, the end cap member effectively closes off the open end of the top cap member, and defines a substantially continuous contour therewith, not only along the upper profile, but also along the lower edges.

Figure 16:
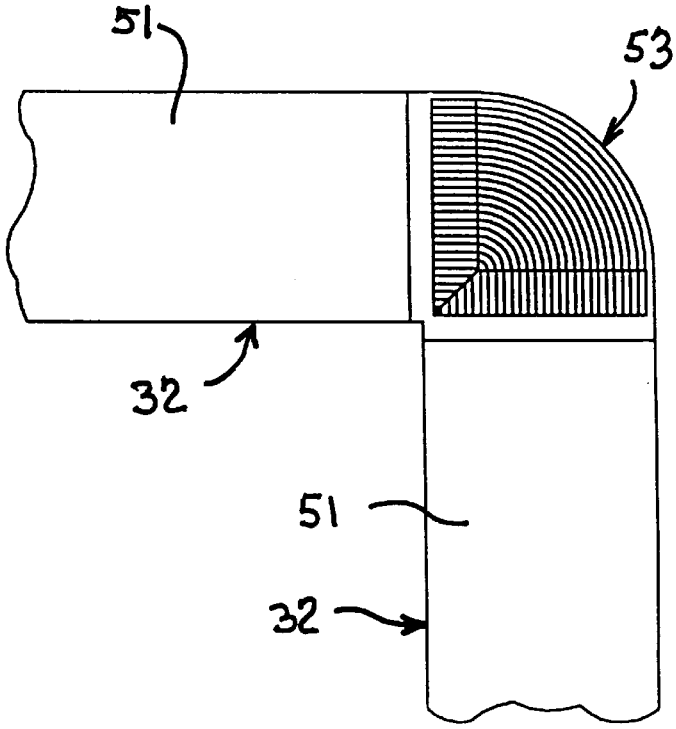
FIG. 16 is a top view which illustrates a corner arrangement defined by two panel members disposed in right angle relationship and having a right-angle corner cap connected between the top cap members of the adjacent panels.
Figure 17:
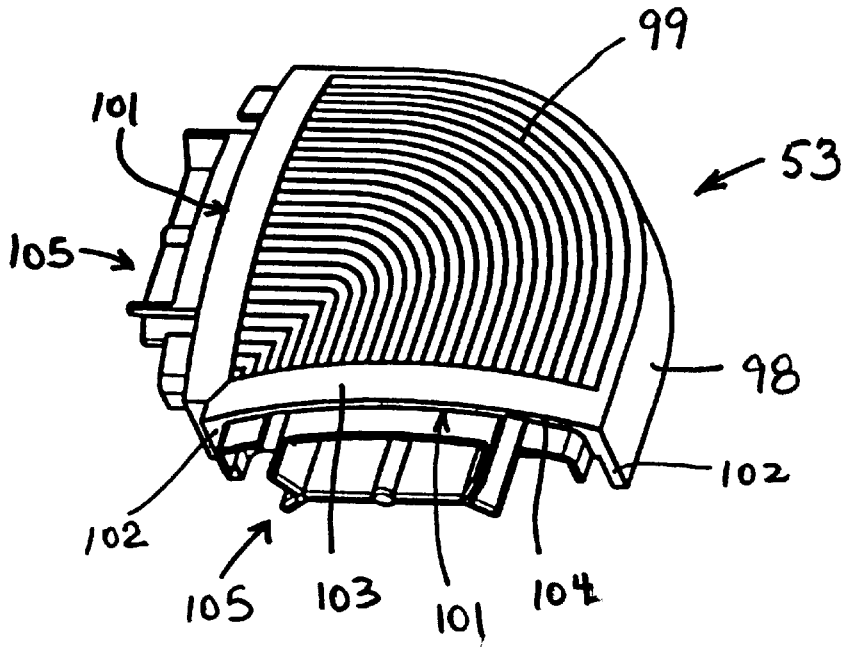
FIG. 17 is a top perspective view of the right-angle corner cap.
Figure 18:
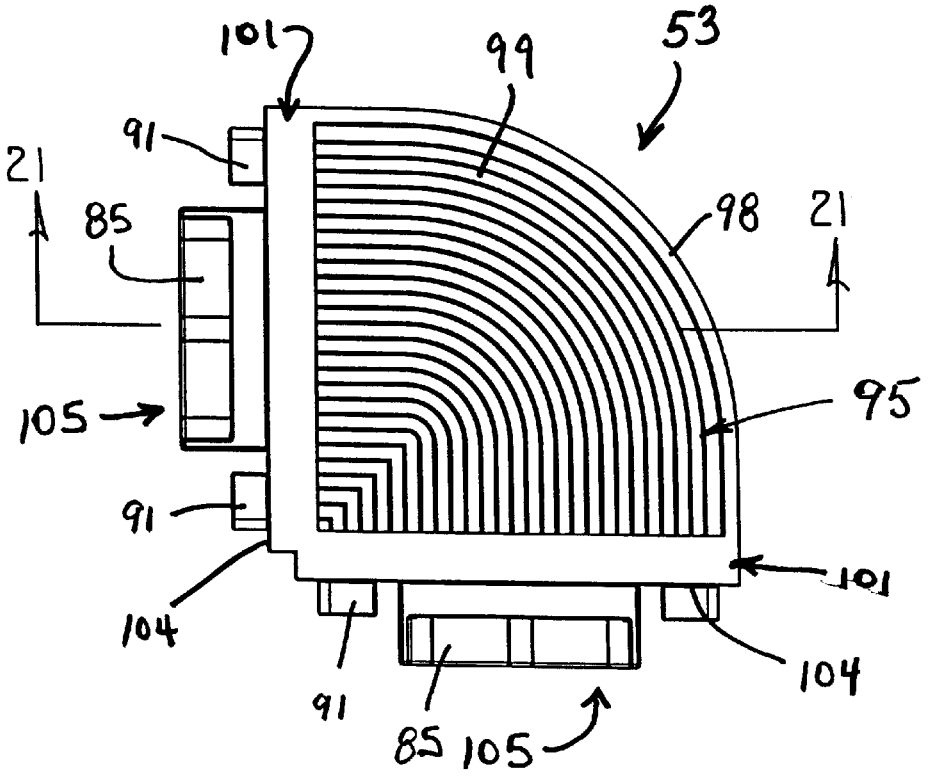
FIG. 18 is a top view of the right-angle corner cap.
Figure 19:
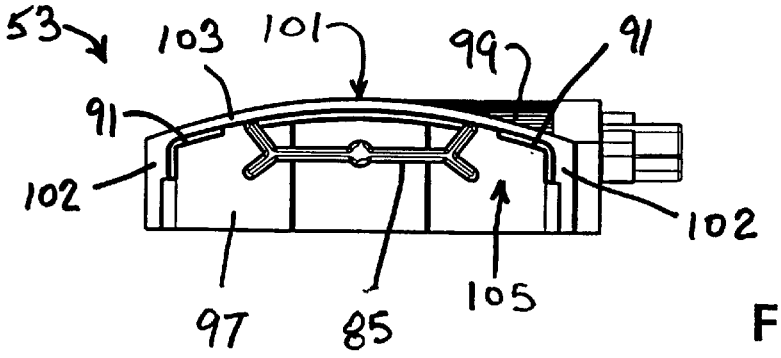
FIG. 19 is an end elevational view of the right-angle corner cap taken from the left side in FIG. 18.
Figure 20:
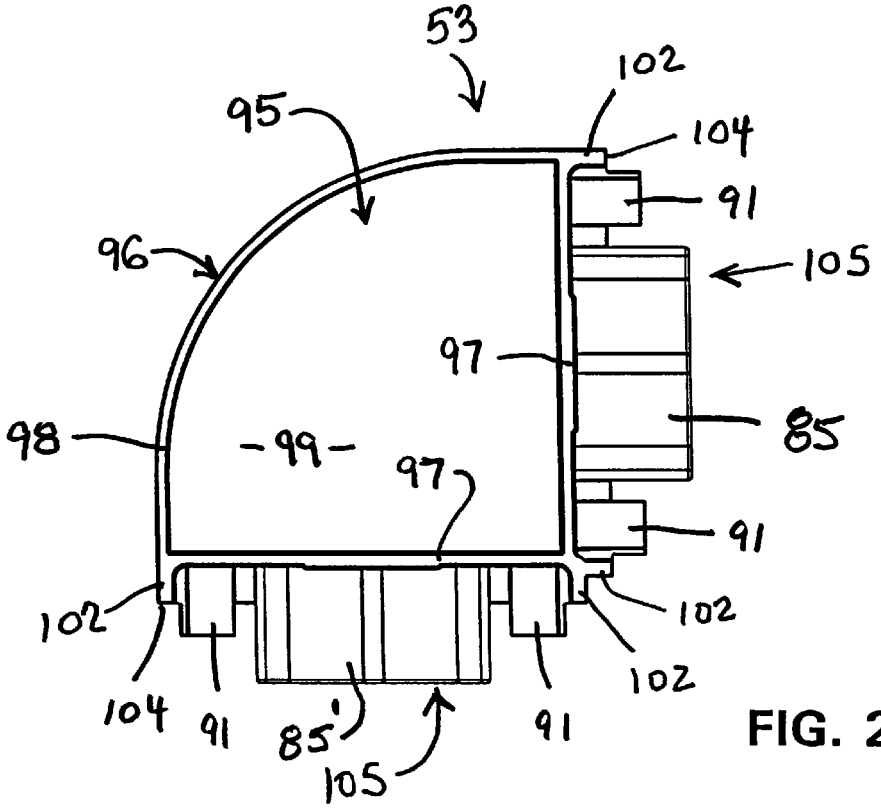
FIG. 20 is a bottom view of the right-angle corner cap.
Figure 21:
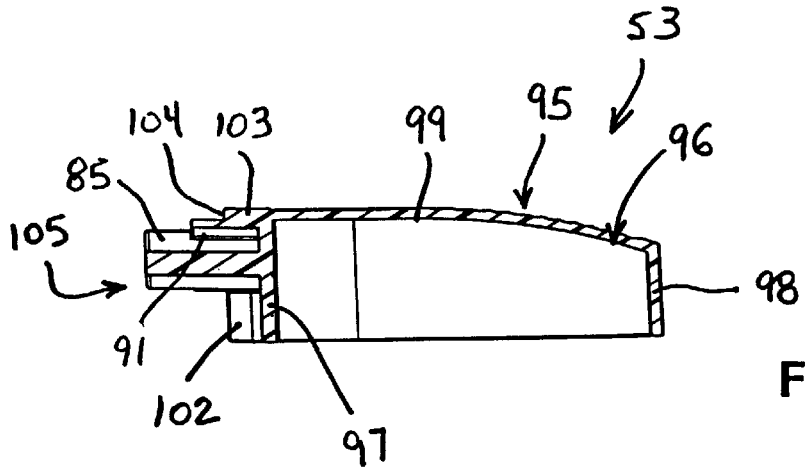
FIG. 21 is a central cross-sectional view of the right-angle corner cap as taken generally along line 21—21 in FIG. 18.

When forming a corner between two transversely disposed panels, such as a right-angle corner between two panels 32 as illustrated in FIG. 16, each panel member 32 has a top cap member 51 mounted thereon. The adjacent ends of the top cap members, namely the ends located at the corner, are in this instance not provided with end cap members. Rather, the adjacent ends of the top cap members as mounted on the panel members defining the corner are in turn directly joined together by the right-angle two-way corner cap member 53.

The corner cap member 53, as illustrated by FIGS. 17–21, is a one-piece structure which has a horizontally-enlarged center portion 95 which is defined by a generally downwardly-opening boxlike housing 96. This housing 96 includes a pair of upright end or edge walls 97 which are, at adjacent ends, rigidly joined together in generally perpendicular relationship, with the individual end walls being disposed generally within vertical planes. The other ends of the end walls 97 are in turn joined together by a similar outer edge wall 98 which, in the illustrated embodiment, has a rounded convex curvature so as to extend through an angle of about 90°, whereby the edge walls 97 and 98 thus effectively define a closed endless peripheral wall. This peripheral wall in turn is joined at the upper edges and enclosed by means of a top wall 99. The top wall 99, substantially at its intersection with each of the end walls 97, has a rounded convex curvature which generally corresponds to the rounded curvature of the top wall 57 on the top cap member 51.

Each of the end walls 97 has a U-shaped rim 101 which extends around the side and upper edges thereof, and which is cantilevered horizontally outwardly away from the interior of the housing 96. Each of the rim walls 101 includes a top rim wall 103 which extends along the upper edge and projects outwardly relative to the respective end wall 97, and this top rim wall 103 in turn joins at opposite ends to downwardly projecting edge rim walls 102 which project downwardly and terminate substantially at the lower edge of the end wall 97. The rim walls 101, 102 have a size and configuration which identically corresponds to the rim walls 81, 82 associated with the end cap member as described above, and at their outer free ends terminate in a free edge or shoulder 104.

Each of the end walls 97 has a coupling structure 105 projecting outwardly therefrom for cooperative engagement with an opposed end of the respective top cap member 51. This coupling structure 105 includes a first projection structure 85' which is substantially identical to the first projection structure 85 associated with the end cap member as described above, the only difference being that the projection structure 85' does not have a wedge-shaped catch 88 associated therewith. The coupling structure 105 also has a pair of second projections 91 projecting outwardly from the respective end wall, which projections 91 are identical to the corresponding projections 91 associated with the end cap member as described above.

The coupling structure 105 associated with each of the end walls 97 of the corner cap member 53 cooperates with the adjacent end of the respective top cap member 51 in the same manner described above relative to the end cap member, and thus further detailed description of the corner cap member 53 is believed unnecessary.

While the right-angle corner cap member 53 illustrates the outer edge wall 98 as being rounded through an angle of about 90° so that the top cap member has a generally elbow-shaped configuration when viewed from above, it will be appreciated that the outer edge wall 98 could be defined by two walls extending in generally perpendicular relationship, and extending respectively parallel to the end walls 97, so as to define a generally square or rectangular configuration if desired.

When three or more panel members are disposed to define a multiple panel corner, such as a T-shaped configuration as illustrated in FIG. 22, then according to the present invention, the top cap members 51 of the serially-aligned but spaced panel members 32A are joined together by a two-way straight corner connector cap member 54, with the third transversely-extending panel 32B being provided with an end cap member 52 secured to the end of its respective top cap member 51, which end cap member effectively nests into one side of the straight connector cap 54.

Referring to FIGS. 23–28, the two-way straight connector cap member 54 includes a horizontally enlarged center portion 111 which is defined generally by a shallow downwardly-opening boxlike housing 112. The latter includes a pair of generally parallel upright end walls 113 which are rigidly joined by a pair of parallel upright side walls 114. The walls 113 and 114, which are all generally vertically oriented, hence define a generally rectangular endless perimeter wall, the top of which is closed by an appropriate top wall 115. The top wall 115, where it merges with each of the end and side walls 113 and 114, has an arcuate convex configuration which generally corresponds to the top wall 57 of the top cap member 51.

Each of the end walls 113 has a generally U-shaped rim 116 associated with and projecting horizontally outwardly generally about the outer edge thereof. The rim wall 116 has a size and configuration which generally corresponds to the rim walls associated with the end and corner cap members 52 and 53, and in the illustrated arrangement includes a top rim wall 116 which is cantilevered outwardly from and extends along the upper arcuate edge of the respective end wall 113. This top rim wall 116 in turn at opposite ends joins to vertically downwardly extending edge rim walls 117 which also project outwardly from the end wall and terminate generally flush with the lower edge thereof.

Each of the end walls 113 also has a coupling structure 121 which is fixed thereto and projects transversely outwardly therefrom for engagement within an opposed end of the respective top cap member 51. This coupling structure 121 is identical to the coupling structure 105 associated with the corner cap member 53, as discussed above.

Figure 24:
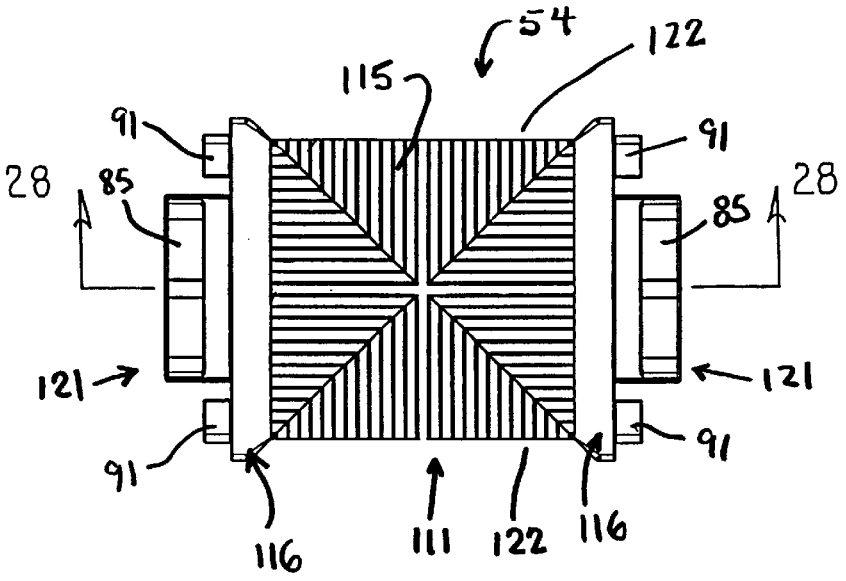
FIG. 24 is a top view of the connector cap of FIG. 23.
Figure 25:
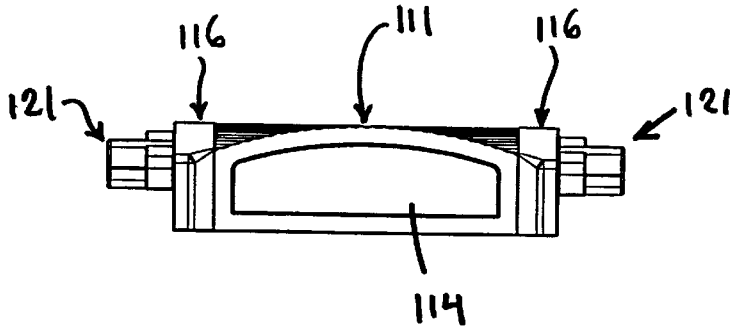
FIG. 25 is an end elevational view of the connector cap of FIG. 24 and illustrating same as taken from either the upper or lower sides in FIG. 24.
Figure 26:
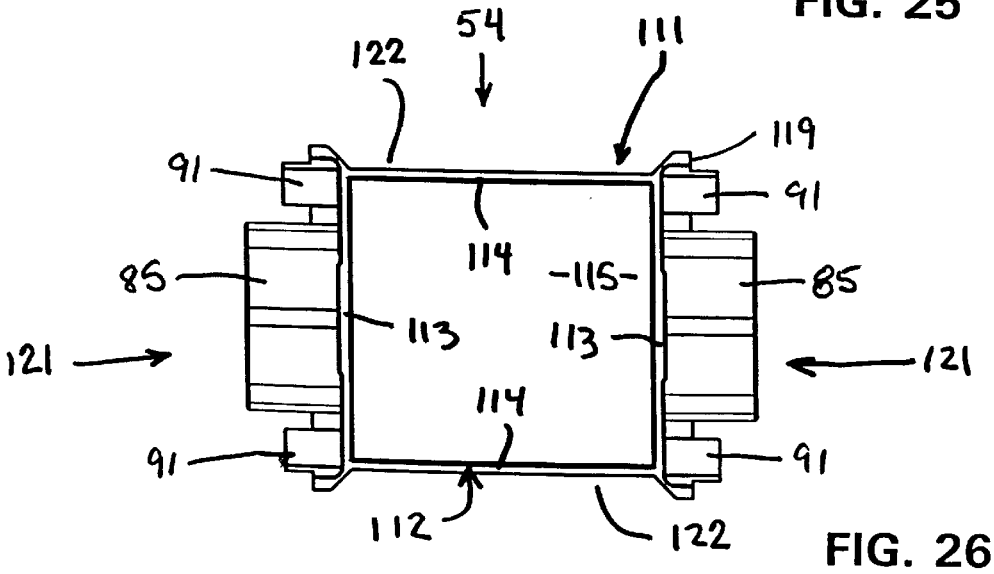
FIG. 26 is a bottom view of the connector cap of FIG. 24.
Figure 27:
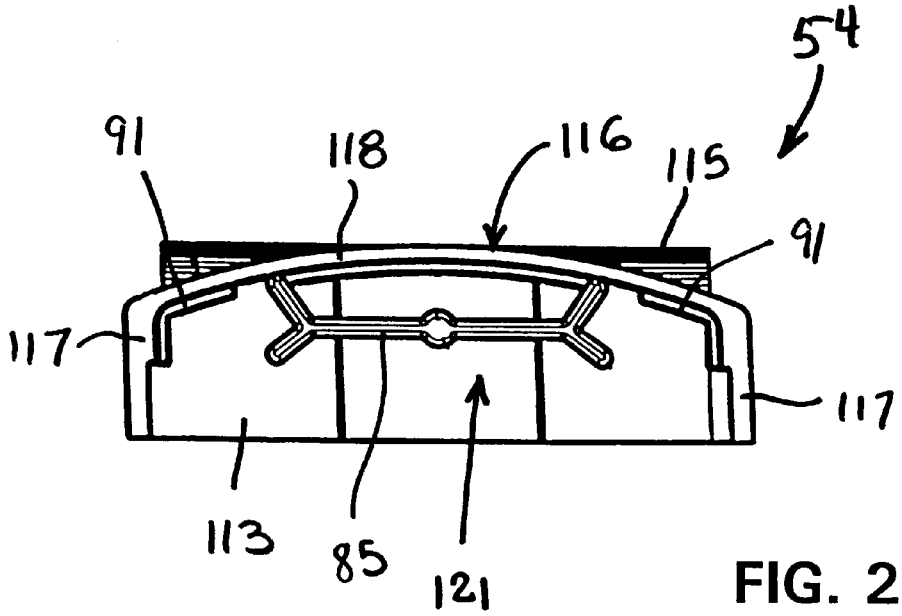
FIG. 27 is an enlarged end elevational view taken from either the right or left side of FIG. 25.
Figure 28:
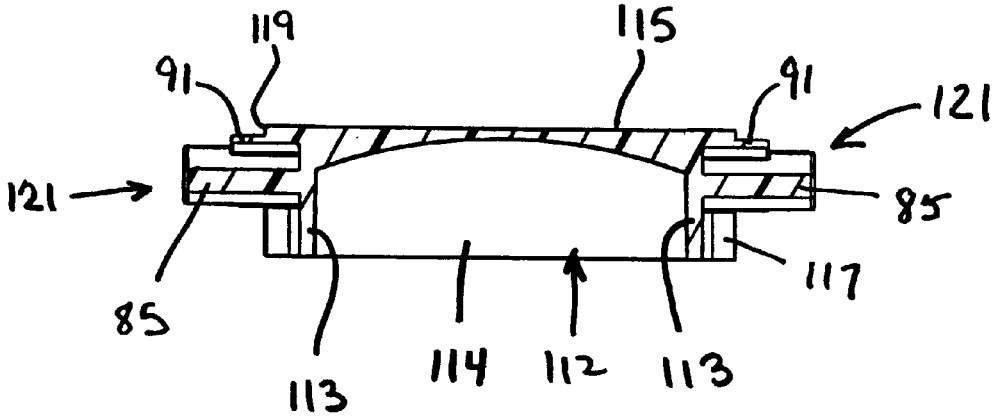
FIG. 28 is a cross-sectional view taken generally along line 28—28 in FIG. 24.

The straight connector cap member 54, as illustrated by FIGS. 24 and 26, also defines a shallow recess 122 on each side thereof, which recess at the bottom thereof is defined by the side wall 114. This recess 122, which extends vertically through the center portion of the cap member 54, is dimensioned so as to have a size and shape which is complementary to the exterior configuration of the end cap member 52 so that the end cap member associated with the third panel 32B, as illustrated in FIG. 22, can effectively nest into one of the recesses 122 to provide a compact and aesthetically pleasing appearance to the overall cap structure at the region where the three panels join to define a T-connection. The end cap 53, however, merely nests within the recess 122 and does not structurally connect to the straight cap 54.

It will be appreciated that a fourth panel can be disposed at the junction illustrated in FIG. 22 so that the fourth panel would extend in serially aligned relationship with the panel 32B, with the end cap of the fourth panel nesting into the upper recess 122.

The generally U-shaped rim wall and the associated coupling structure as associated with each of the cap members 53 and 54 will cooperatively engage with the end of the top cap member 51 in the same manner illustrated by the engagement of the latter with the end cap member 52 in FIG. 14A, except that the corner cap members 53 and 54 do not have a catch 88 associated therewith. Further detailed description of the end cap members 53 and 54, and their interconnection to the top cap members 51, is thus believed unnecessary.

Each of the cap members 52, 53 and 54 are preferably formed in one piece of a plastics material, such as by being molded of PVC, for example, and hence can be provided with desirable dimensional stability so as to provide for desired operative cooperation with the top cap members 51. When assembled, the cap members 52, 53 and 54 hence all have a snug inter-fitting engagement with an opposed end of a top cap member 51 so that the cap members 52, 53 and 54 thus maintain a substantially continuous structural appearance which is free of abrupt discontinuities or separations. At the same time, the side flanges 58 of the top cap member 51 and the side rim walls associated with each of the cap members 52, 53 and 54 effectively project downwardly in straddling relationship over a small vertical extent of the panel member at the upper edge thereof, thereby preventing creation of any unsightly appearance even if the top cap member undergoes slight vertical distortion or displacement relative to the panel member. Further, the snug engagement of the top cap member with the panel member, which snug engagement is created both by the engagement of the side flanges 58 with the outer surfaces, and the frictional engagement of the retaining flanges 66 within the interior of the top frame rail, greatly assist in snugly and properly holding the top cap member on the panel member so as to prevent inadvertent or accidental release or separation thereof, and hence maintaining the desired overall assembled appearance.

At the same time, the top cap can be readily removed from the panel member when desired merely by gripping the top cap member and applying sufficient upward lifting force as to effect separation thereof from the panel member. When such is carried out, if the top cap member has end cap members 52 mounted thereon, then such end cap members will remain secured to and be carried with the top cap member 51.

In addition, the provision of the end cap member 52 and its mounting on the top cap member 51 ensures that these two members are always properly aligned, but at the same time the end cap member 52 has a sufficient interior recess as to accommodate therein the upper end of the edge rail 39 (i.e., the upper corner of the panel), whereby any manufacturing tolerances which exist with respect to the panel member are readily hidden by the top cap arrangement, and thus the overall appearance of the panel with the top cap arrangement mounted thereon is uniformly maintained. Further, the provision of the retaining flanges 66 and their disposition throughout substantially the entirety of the top cap member hence ensures that desirable gripping engagement exists between the top cap member and the top frame rail throughout substantially the entirety of the top cap member, and thus undesired bowing or warping of the top cap member is effectively eliminated. While the present invention discloses the retaining flanges 66 as being continuous throughout substantially the entire length of the top cap member, except for short distances at the free ends thereof, it will be appreciated that the flanges 66 could be defined by a plurality of longitudinally adjacent segments positioned so as to extend substantially throughout the length of the top cap member, so long as the spacing between such segmented flanges is not large so that the plurality of segmented flanges as they extend longitudinally throughout the length of the top cap member still effectively function substantially as a longitudinally continuous flange.

The top cap arrangement of the present invention is also highly desirable since the overall number of parts is significantly minimized. For example, the top cap member attaches directly to the frame of the panel member without requiring separate retaining clips or brackets, and all of the end or corner cap members attach directly to and are carried directly by the top cap members without requiring additional attachment points or structures. At the same time this simplified arrangement compensates for tolerance-caused dimensional variations in the basic structure of the panel without causing distortion or change in the overall desired configuration of the panel when the top cap arrangement is mounted thereon, thereby achieving improved aesthetics while permitting use of a simplified top cap arrangement.

In summary, the top cap member 51 of the present invention, by provision of the central tubular section which extends lengthwise of the top cap member, hence provides structure to ensure appropriate flatness and hence provide accurate engagement when seated on the panel, and at the same time the downwardly opening channels defined between the side flanges 58 and the opposed side walls 62 coupled with the flexibility of the flanges 58 readily accommodate manufacturing variations in the overall construction of the panel member and also accommodate fabric selection (i.e., variations in fabric thickness) without affecting the desired fit of the top cap member on the panel. The tubular section associated with the top cap member also provides an enclosed feature to ensure consistent fit with the end cap member, and the retaining flanges 66 provide positive guiding and retention of the top cap member into and on the panel. As to the end cap member 52, it readily accommodates variation in panel length without affecting overall appearance, when used in conjunction with the straight corner connector 54 it significantly minimizes the gap between the top cap members of adjoining panels so as to provide a cleaner and more uniform appearance, and it provides a positive press fit engagement into the enclosed tubular section of the top cap member. Lastly, as to the two-way and three-way corner connector caps 53 and 54, they provide the same positive press fit engagement into the top cap member as does the end cap member, they provide a desirable appearance with respect to continuity with respect to the top cap arrangement when two-way and three-way corners are provided, and they reduce the number of parts required at these corner connections so as to not only improve overall appearance but simplify assembly.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In combination, an upright interior space-dividing wall panel having a generally rectangular configuration defined by generally parallel upper and lower edges which are horizontally elongated and are joined by generally parallel side edges which extend vertically therebetween, the panel defining therein an upwardly opening channel which extends lengthwise of the upper edge, the panel also having exterior side surfaces which define substantially parallel vertical planes, and a removable top cap structure which mounts on and extends lengthwise along the upper edge of said panel, comprising the improvement wherein said top cap structure includes an elongate one-piece top cap member which mounts on said upper edge and extends therealong through a length which approximately equals but does not exceed the length of said upper edge, said top cap member including a lengthwise extending outer channel part which opens downwardly and includes a top wall and a pair of side flanges which project downwardly from opposite lengthwise-extending edges of said top wall and which have downwardly cantilevered lower portions, the sideward spacing of said side flanges enabling said lower portions thereof to vertically overlap the exterior side surfaces of the panel in the vicinity of said upper edge, said top cap member also including a lengthwise-extending upwardly-oriented inner channel part which includes a bottom wall which is spaced downwardly from said top wall and extends between a pair of side walls which are disposed between and in inwardly-spaced relation from said side flanges, said side walls extending upwardly and joining to a center portion of said top wall, said inner channel part and the center portion of said top wall defining a tubular structure which extends throughout the length of said outer channel part, said bottom wall seating against the upper edge of said panel member, said top cap member further including a pair of sidewardly-spaced resiliently flexible retaining flanges which extend lengthwise of said tubular section and are cantilevered downwardly from said bottom wall for projection into said channel to create a releasable engagement with the panel member.

2. The combination of claim 1, wherein the side flanges of said outer channel part project downwardly and terminate at lower free edges which are disposed at an elevation which is a substantial distance below the bottom wall of said inner channel part.

3. The combination according to claim 1, wherein said retaining flanges join to said bottom wall at locations spaced inwardly from said side walls so that said bottom wall includes a pair of spaced contact areas defined on opposite sides of said retaining flanges, said spaced contact areas being disposed in seating contact with the top edge of said panel when said top cap member is mounted thereon.

4. The combination of claim 1, wherein said retaining flanges have sidewardly-directed projections which create a resilient but releasable snap-fit engagement within a channel-shaped top rail structure which extends lengthwise of and defines the upper edge of said panel.

5. The combination of claim 1, wherein the pair of side walls and the pair of side flanges are positioned substantially symmetrically on opposite sides of a vertical center plane which extends lengthwise of the top cap member, and wherein each said side wall is inwardly spaced from the respectively adjacent side flange so as to define a channel like space therebetween which opens downwardly and is closed at the upper end by said top wall.

6. The combination of claim 1, wherein the top cap assembly includes a one-piece end cap member which is engaged with and carried on the top cap member at the free end of the latter for closing off the end of the top cap member, said end cap member including an upright wall structure which extends transversely across the end of the top cap member and which has an overall height which corresponds to the height of the top cap member, said upright wall having a lower free edge which is substantially horizontally coplanar with lower edges of said side flanges and which vertically overlaps a vertically-extending end edge of the panel in the vicinity of the upper edge thereof, said end cap member having a projection which extends transversely from said upright wall and projects into an open end of said top cap member for fixed engagement therebetween.

7. The combination of claim 1, wherein said top cap assembly includes an end cap member which includes a lower wall structure which telescopes downwardly in surrounding relationship to an upper corner of the panel and an upper wall structure which effectively defines an extension of and closes off the end of the top cap member, said upper wall structure including a projecting structure which is snugly slidably engaged within the end of said top cap member to fixedly and positionally connect said end cap member to said top cap member.

8. The combination of claim 7, wherein said projecting structure includes a part which is cantilevered substantially horizontally from said upper wall structure and projects into the tubular section of the top cap member for creating a snug slidable engagement therewith.

9. The combination of claim 7, wherein the projecting structure includes a pair of cantilevered elements which project transversely from the upright wall structure and project into the end of the top cap member for slidably engaging the underside of said main channel part in the vicinity of corners defined where the side flanges join to the top wall.

10. The combination of claim 6, including a releasable catch structure cooperating between the projection and the top cap member for creating a positive but releasable joining of the end cap member to the top cap member, the releasable catch including an opening formed through the bottom wall of the top cap member in close proximity to the free end thereof and a wedge-shaped catch fixed to the projection and projecting downwardly therefrom for engagement within said opening when said projection is inserted into the tubular section of said top cap member.

11. The combination of claim 1, wherein the top cap assembly includes a separate one-piece end cap member which mounts on said top cap member at a free end thereof for closing off the end of the top cap member, said end cap member including an upright platelike end wall which extends transversely across the top cap member adjacent the free end thereof, said upright end wall having top and side edges which join to a peripheral rim wall which is cantilevered generally transversely from said end wall and projects toward and contacts the free end of said top cap member, said peripheral rim wall having a size and configuration which corresponds to the size and configuration of the outer channel part of said top cap member and which terminates in an end edge which abuts against an end edge of said outer channel part, and an elongate projection disposed within said rim wall and cantilevered transverse to said upright end wall and extending outwardly to a location beyond the end edge of said rim wall, said projection being snugly slidably engaged with inner walls of said top cap member.

12. In an interior upright space-dividing wall system having a plurality of interior, upright, space-dividing wall panels which cooperate to at least partially define workspaces, including first and second said panels having upright end edges disposed in adjacent relationship to define a corner, and a top cap arrangement mounted on and extending along upper edges of said first and second panels and extending therebetween at said corner, the improvement wherein said top cap arrangement comprises:

an elongate one-piece top cap member releasably fixed to and extending along an upper edge of each of said first and second panels, said top cap member having a length which does not exceed the length of the upper edge of the respective panel and which terminates in free ends which are respectively disposed adjacent upper corners of the respective panel;

said top cap member including a tubular part which extends the length of the top cap member and includes vertically spaced top and bottom walls, said top wall defining the exposed upper wall of the top cap member, and said bottom wall being seated on the respective panel along the upper edge thereof;

said top cap member having a pair of side flanges which are sidewardly spaced to accommodate the width of the respective panel therebetween, said side flanges being cantilevered downwardly to vertically overlap exterior side surfaces of the respective panel through a small vertical distance which extends downwardly from the upper edge of the panel, said side flanges having at least limited resilient flexibility to embrace the panel therebetween; and a one-piece corner cap member disposed at the corner and extending between the adjacent free ends of the top cap members mounted on said first and second panels and being supportedly engaged with said top cap members, said corner cap member having substantially identical first and second edge walls each having an exterior size and configuration which corresponds to the exterior size and configuration of the top cap member at the free end thereof, each said edge wall being disposed in abutting engagement with the free edge of the respective top cap member to effectively define an extension thereof;

said corner cap member also including a projection which is associated with and cantilevered outwardly beyond each said end edge wall and which projects into the tubular part of the respective top cap member at the free end thereof to create a snug slidable engagement therewith, whereby said corner cap member is supported and carried by said top cap members.

13. A system according to claim 12, wherein said top cap member includes a horizontally enlarged center portion which defines a shallow boxlike housing defined by a top wall secured to a downwardly projecting endless peripheral wall which extends around said top wall, said peripheral wall including first and second end walls which respectively have said first and second edge walls associated therewith, and a said projection being fixed to and cantilevered transversely outwardly from each of said end walls.

14. A wall system according to claim 13, wherein said first and second panels are disposed to extend in generally perpendicular relationship to one another, and wherein said first and second end walls of said corner cap member extend generally perpendicularly with respect to one another and are joined together to define a generally right-angle corner.

15. A wall system according to claim 13, wherein said first and second panels are disposed in horizontally aligned but spaced relationship with opposed edge surfaces of said first and second panels being spaced apart by a distance which approximately equals the panel width, said corner including a third panel having one end edge thereof positioned adjacent said first and second panels and extending perpendicularly relative to said first and second panels, said corner cap member being supported on the top cap members of said first and second panels and spanning across the distance between the opposed adjacent edge surfaces thereof, said third panel having a said top cap member mounted thereon and cooperating with said corner cap member for providing a substantially continuous appearance therewith.

16. A wall system according to claim 15, wherein the top cap member of said third panel has a one-piece end cap member which is mounted on and closes off the free end of the top cap member of said third panel, said end cap member being positioned on the upper corner of said third panel and disposed in substantially abutting contact with a side wall of said corner cap member.

17. A wall system according to claim 16, wherein the side wall of said corner cap member defines therein a shallow recess which extends between the first and second end walls so as to accommodate therein the end cap member mounted on said third panel.

18. A wall system according to claim 12, wherein said top cap member has a pair of sidewardly spaced retaining flanges which are fixed to and extend lengthwise along said bottom wall, said retaining flanges being cantilevered downwardly from said bottom wall and having at least limited transverse flexibility and being resiliently releasably engaged within an upwardly opening channel which is formed in the respective panel and extends lengthwise along the upper edge thereof.

* * * * *